United States Patent [19]

Spain

[11] 4,337,867

[45] Jul. 6, 1982

[54] CURANE BOOM PIVOT STRUCTURE

[75] Inventor: Stanley R. Spain, Greencastle, Pa.

[73] Assignee: Kidde, Inc., Clifton, N.J.

[21] Appl. No.: 177,646

[22] Filed: Aug. 13, 1980

[51] Int. Cl.[3] ..... B66C 23/26

[52] U.S. Cl. ..... 212/181

[58] Field of Search ..... 212/175, 179–181; 414/686; 52/116

[56] References Cited

U.S. PATENT DOCUMENTS 3,139,198 6/1964 Penney et al. ..... 212/181 X 3,812,979 5/1974 Leihgeber ..... 212/180

*Primary Examiner*—Robert G. Sheridan

*Attorney, Agent, or Firm*—Brady, O'Boyle & Gates

[57] ABSTRACT

The pivot shaft for the boom of a large mobile construction crane is located near the upper side of the boom base section and its opposite ends are journaled in heavy bearings mounted on vertical side supports rising from a boom turntable. To lock the boom to the boom pivot shaft for unison rotation in the pivot shaft bearings, a single locking pin is received through registering openings in the pivot shaft and a surrounding hub or pillow block fixed to the boom structure within the confines of an internal box support. A screw-threaded extension on the locking pin engages a nut on the exterior of the boom base section, the nut being floatingly constrained by fixed guide tracks which prevent nut rotation with the threaded locking pin while allowing limited lateral and angular adjustment of the locking pin. A cross axis tethered removable retainer pin carried by the nut prevents backing out of the locking pin from its locking position and can only be inserted in the nut when the locking pin is fully in the locking position. The threaded locking pin overcomes a problem of inaccessibility of the interior end of the locking pin within the internal box support.

11 Claims, 6 Drawing Figures

CURANE BOOM PIVOT STRUCTURE

BACKGROUND OF THE INVENTION

The development of mobile construction cranes in ever-increasing sizes and greater degrees of sophistication has inevitably created certain mechanicl problems not found in smaller and more primitive cranes. In the largest cranes employing hydraulically operated telescoping booms, the axis of the boom pivot shaft has been raised to a point near the upper surface of the boom base section, thus allowing the major portion of the boom structure in the vertical plane to depend from the pivot shaft and nest between the two rising supports for the pivot shaft on the boom turntable. The arrangement is compact and very sturdy. The interior space within the boom base section immediately surrounding the pivot shaft is partly obstructed by an internal structural box member. Additionally, the interior space is utilized to house various accessory items which are required on the latest types of large telescoping boom cranes.

As a result, access to the interior end of the customary locking pin for the boom pivot shaft is difficult or impossible so that the locking pin cannot be hammered out of the cross opening in the pivot shaft when it is necessary to remove the pivot shaft in order to separate the boom from the turntable on a crane carrier.

This invention has for its main objective to solve this problem of boom pivot shaft locking pin removal in a safe and efficient manner where access to the interior end of the locking pin is difficult or impossible.

A further object of the invention is to utilize a locking pin receiver hub immediately surrounding the boom pivot shaft at the center of the shaft as an additional bearing support to resist deflection or bending of the pivot shaft.

Still another object of the invention is to provide a constraining means for the external nut which engages the screw-threaded extension of the locking pin which is constructed to allow a certain degree of lateral and angular adjustability of the locking pin and a certain degree of floating movement of the nut.

Another object and feature of the invention is the provision on the nut of a removable cross axis retainer pin for the threaded pivot shaft locking pin, thus preventing backing out of the locking pin due to vibration. The retainer pin cannot be inserted until the threaded locking pin is in the full lockingposition in the boom pivot shaft and thus forms a safety indicator to show that the pivot shaft is rigidly locked to the boom base section so that no relative rotation between these elements can occur.

Other features and advantages of the invention will become apparent during the course of the following detailed description.

DETAILED DESCRIPTION

Figure 1:
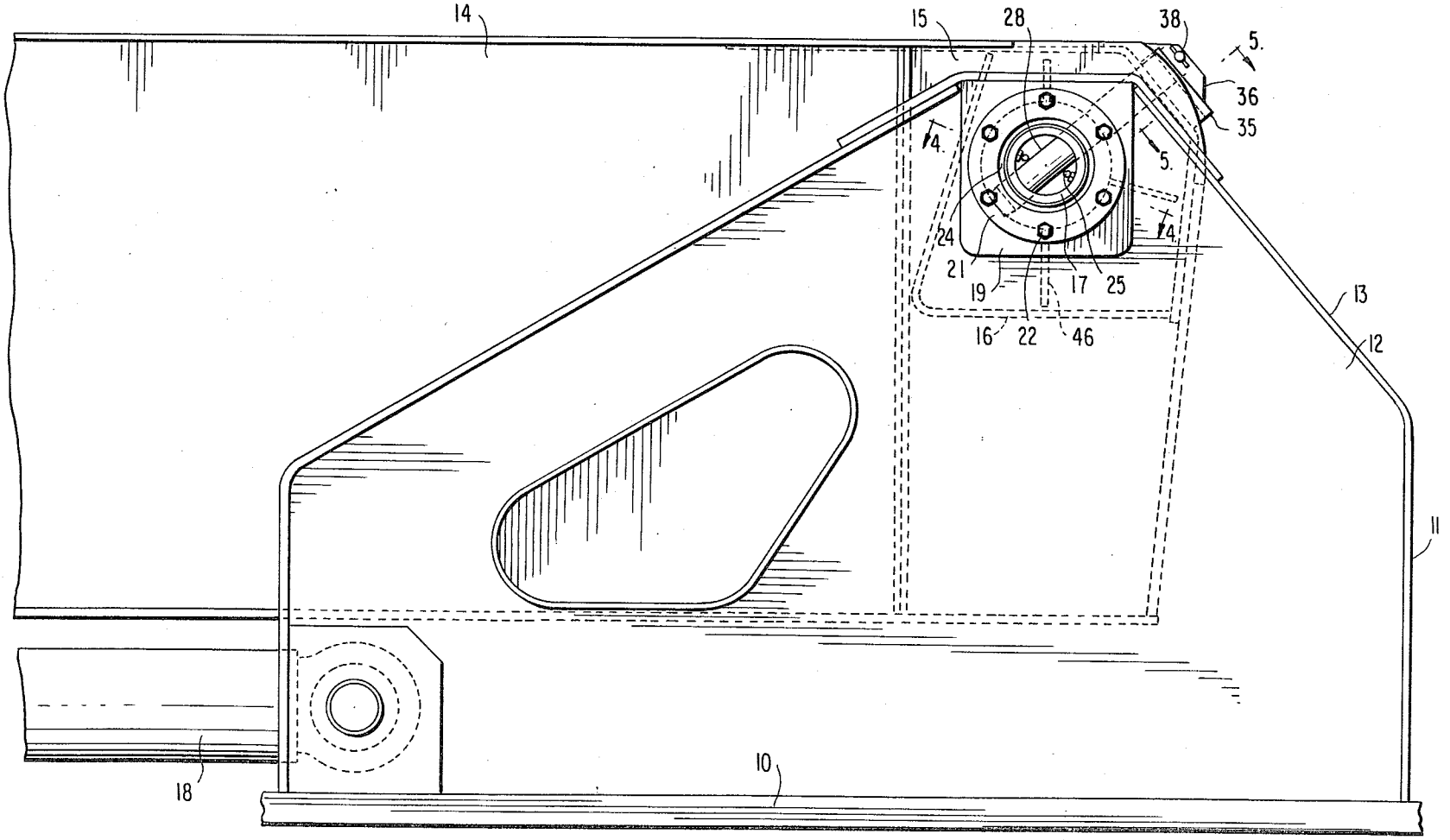
FIG. 1 is a fragmentary side elevation showing the base section of a telescoping crane boom, its turntable support, pivot shaft and pivot shaft locking pin and associated elements.
Figure 4:
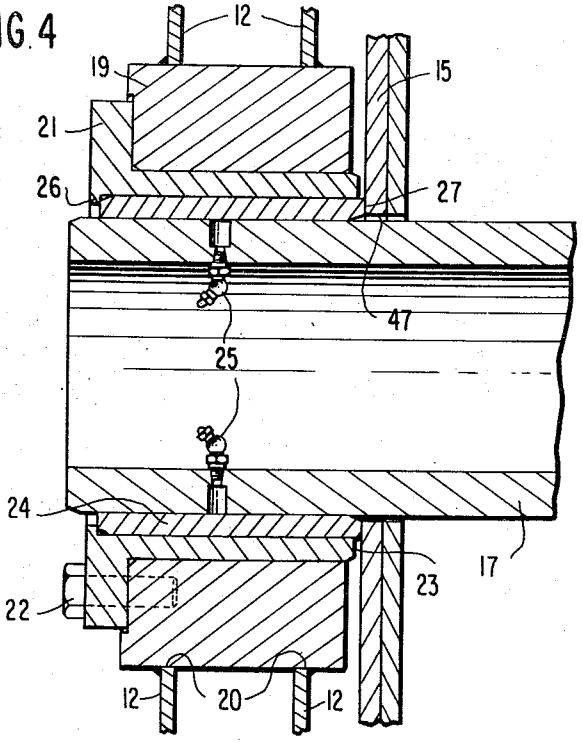
FIG. 4 is an enlarged fragmentary section through one pivot shaft bearing taken on line 4—4 of FIG. 1.
Figure 5:
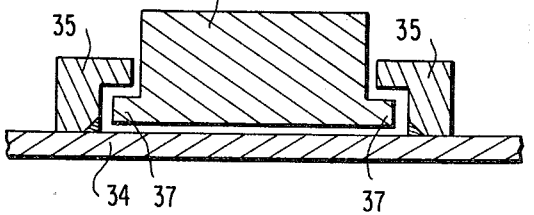
FIG. 5 is an enlarged fragmentary section taken through a locking pin nut and constraint means taken on line 5—5 of FIG. 1.
Figure 2:
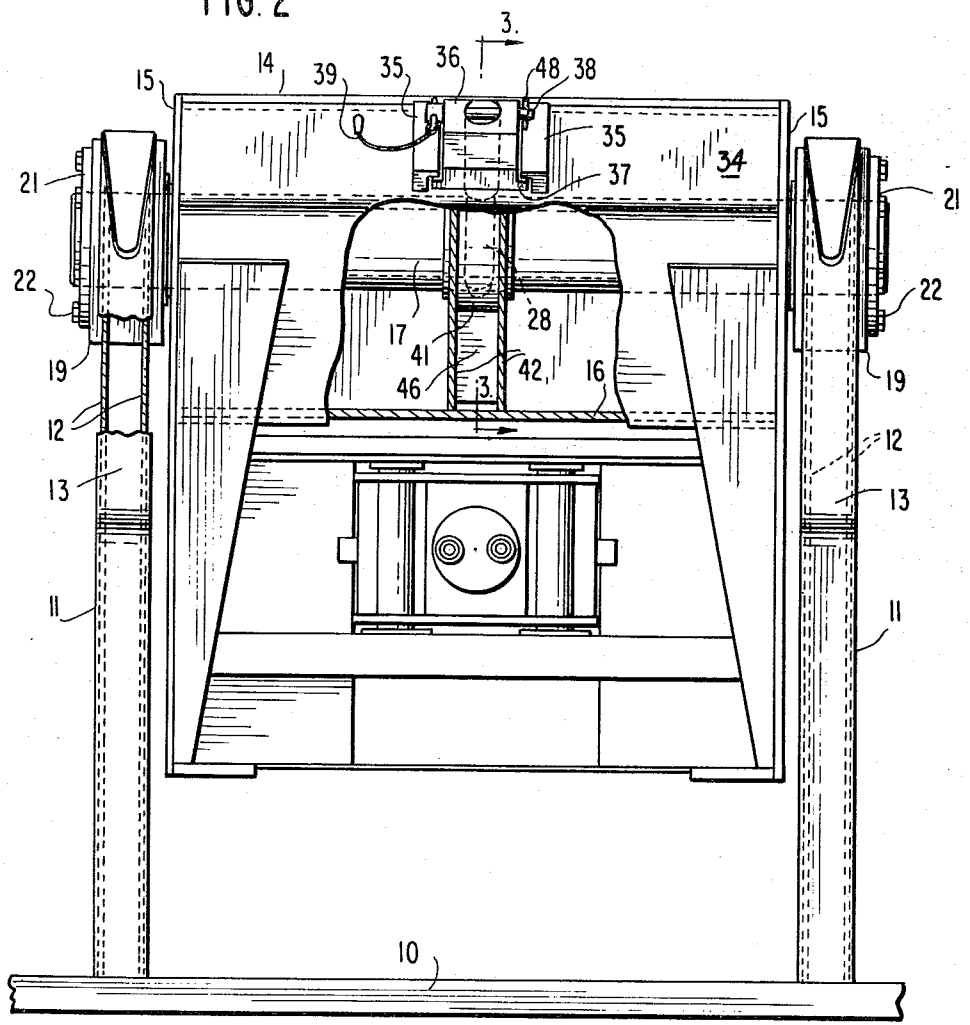
FIG. 2 is a rear end elevation of the structure in FIG. 1, partly broken away and partly in cross section.

Referring to the drawings in detail wherein like numerals designate like parts, a boom turntable 10 mounted on a crane carrier, not shown, includes laterally spaced vertical supports 11 each consisting of a pair of spaced parallel plates 12 and appropriate reinforcing cap plates 13 joined thereto by welding and following the perimeters of the supports 11.

The rearward end of a trapezoidal boom base section 14 engages between the vertical supports 11 and the base section 14 in its region adjacent to the boom pivot axis has built-up rigid side vertical plates 15 which lie close to and inwardly of the two supports 11.

An internal box reinforcing member 16, or torque box, of modified L-configuration extends between the vertical side plates 15 and is welded thereto for rigidity. The boom pivot axis defined by a tubular boom pivot shaft 17 is disposed near the upper rear corner of boom base section 14 within the chamber defined by box member 16.

Additional intermediate and forward telescoping boom sections, not shown, are received within the base section 14 forwardly of pivot shaft 17. Boom lift cylinders 18 are appropriately connected between the turntable boom supports 11 and the lower side of boom base section 14 at a foward location, not shown in the drawings.

The boom pivot shaft 17 has its opposite ends rotatably supported in bearings mounted on the turntable vertical supports 11. Each such bearing comprises a heavy steel block 19 secured by welding within openings 20 of the two spaced plates 12 of each support 11. A flanged steel casing 21 is received within a cylindrical bore of the block 19 and locked to the block by circumferentially spaced screws 22. The interior end face 23 of the steel casing 21 is spaced slightly from the adjacent vertical plate 15 of the boom base section. An aluminum-bronze sleeve bearing 24 is press-fitted into the casing 21 and forms a journal for the adjacent end portion of pivot shaft 17. Internal lubricating fittings 25 for the sleeve bearing 24 are provided on the pivot shaft 17, as shown. The outer end face of each sleeve bearing 24 is abutted by a retaining lip 26 on the steel casing 21. The inner end face 27 of each sleeve bearing 24 abuts the vertical side plate 15 to form a thrust bearing surface therefor. Thus, lateral displacement of the boom is constrained by the end faces 27 of the two pivot shaft bearings.

It is required that the boom base section 14 be rigidly locked to the pivot shaft 17 for rotation in unison therewith, without relative rotation between these elements and with the pivot shaft 17 rotating in the two described bearings or journals. The means for rigidly and releasably locking the pivot shaft 17 to the boom base section forms the principal feature of this invention and comprises an angled locking pin 28 having a forward cylindrical stem which is received through a cross bore 29 in the pivot shaft. A forward extremity 30 on the locking pin 28 is tapered for ease of entry in the cross bore 29. A rear enlarged diameter screw-threaded extension 31 is provided on the locking pin 28 and this extension has a rear end square socket 32 to facilitate removal of the locking pin from the pivot shaft 17 at proper times. A clearance opening 33 for the threaded extension 31 is formed in a cap plate 34 of the boom structure.

Figure 3:
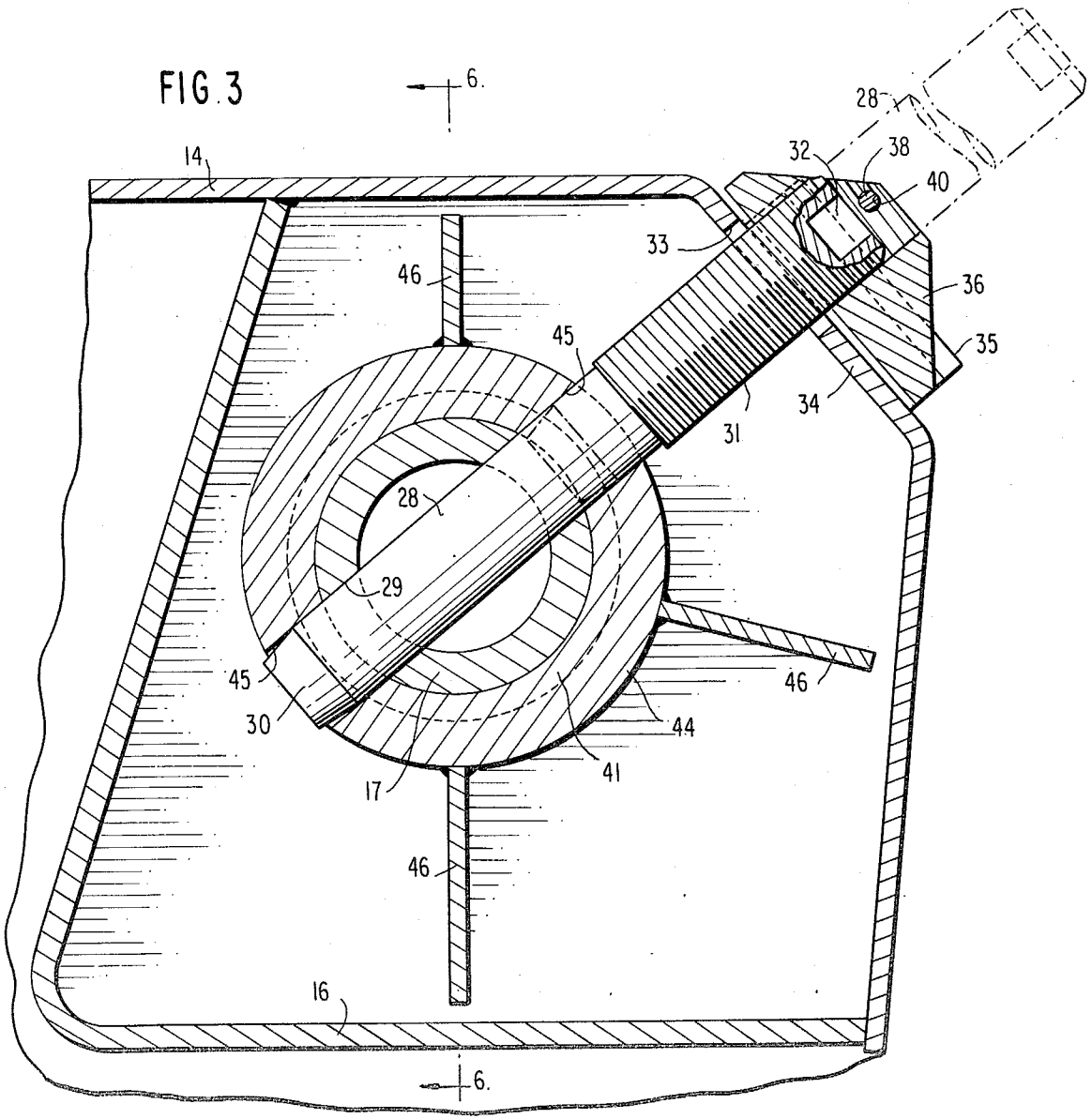
FIG. 3 is an enlarged vertical section through the locking pin taken on line 3—3 of FIG. 2.

On the inclined portion of the cap plate 34 perpendicular to the axis of locking pin 28, a pair of retaining tracks 35 of L-configuration are provided in opposing relationship. The retaining tracks are parallel and are welded to the exterior surface of the cap plate 34. Between the retaining tracks 35 is loosely or floatingly positioned a nut 36 having threaded engagement with the extension 31 of the locking pin. The nut 36 has lower flanges 37 which interfit with the retaining tracks 35 loosely. The retaining tracks prevent rotation of the nut with the locking pin 28 when the latter is turned to retract the locking pin from the pivot shaft 17 to approximately the position shown in phantom lines in FIG. 3, at which point the screw-threads of the extension 31 are substantially disengaged with the threads of the nut and the tapered extremity 30 is outside of the cross bore 29. The loose or floating engagement of the nut 36 between retainer tracks 35 allows enough angular and lateral adjustment of the locking pin 28 to assist in its placement through the cross bore 29 of the pivot shaft for locking the latter rigidly to the boom section 14.

To prevent backing out of the locking pin 28 due to vibration, a removable retainer pin 38 attached by a tether 39 to the cap plate 34 is provided. This retainer pin is received through a cross opening 40 in the nut 36 at right angles to the axis of locking pin 28, and when in place blocks retraction of the locking pin. The retainer pin 38 serves a second important purpose of assuring that the locking pin 28 is home in the full locking position shown in full lines in the drawings. Since the pin 38 cannot be installed until the locking pin 28 is in the full locking position, it serves as an indicator that the pivot shaft lock is safe when in place.

At the center of the pivot shaft 17 in surrounding relation thereto is a sturdy steel hub 41, or pillow block, held between a pair of spaced vertical reinforcing plates 42 which in turn are welded at their lower ends to the horizontal portion of the box member 16 and at their tops and side edges to the cap plate 34 and the inclined wall of the box member 16. The hub 41 is received in aligned openings of the two plates 42 and welded securely to these plates at 43 to form a rigid unit within the interior of the boom structure. An integral annular enlargement 44 on the hub 41 serves to center the hub relative to the plates 42 and further strengthens the assembly.

Figure 6:
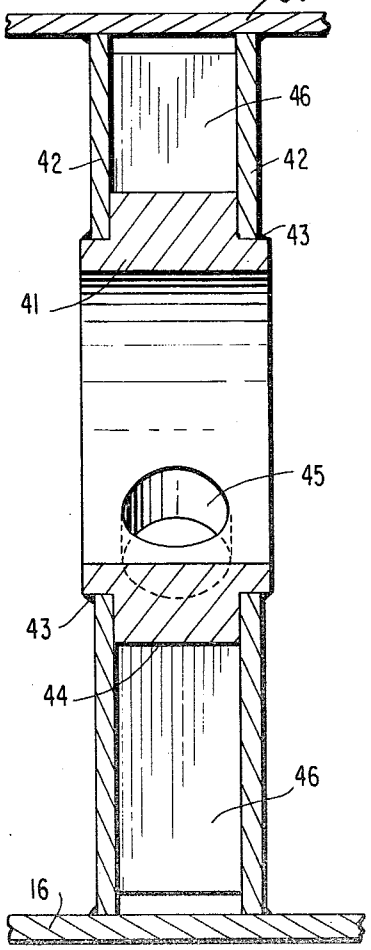
FIG. 6 is a fragmentary vertical section taken on line 6—6 of FIG. 3.

The hub 41 has a cross bore 45 formed therethrough adapted to register with the bore 29 and also receiving the forward stem of the locking pin 28, as shown, to rigidly lock the pivot shaft 17 to the boom base section 14. The hub 41 serves the additional purpose of resisting bending or deflection of the pivot shaft 17 during the operation of the crane boom. For even greater strength and rigidity, the hub 41 has circumferentially spaced radial webs 46 welded thereto between the two plates 42 and also welded to these plates, FIG. 6, and to the bottom of box member 16 to form a spider-like structure. In effect, a central shaft deflection support is provided through the hub 41 for the pivot shaft 17. Further conventional doubler reinforcing plates and/or cap plates are provided on the boom structure, as required, to impart adequate rigidity without unduly increasing weight, and the details of the boom need not be further described for a proper understanding of the invention.

It should be noted that a small clearance is provided between the periphery of pivot shaft 17 and the provided openings 47 in the side vertical plates 15 of the boom base section, the main weight of the boom being borne through the two side bearings 24.

When it is required to separate the boom from the crane carrier, it is merely necessary to remove the safety retainer pin 38 from the nut 36 and unscrew the locking pin 28 to retract it fully from the cross bore 29 of pivot shaft 17. This retraction is accomplished by a suitable tool engaging in the socket recess 32 from the outside of the structure, and it is unnecessary to have access to the interior end of the locking pin 28 to accomplish the retraction. Once retracted, the pivot shaft 17 can be removed axially from its bearings in a conventional manner and the crane boom is then free to be separated from the crane carrier. When the pivot shaft 17 is re-installed through the bearings 24 and hub 41, the locking pin 28 is threaded forwardly to the full locking position and only after this condition is established can the safety retaining and indicator pin 38 be installed and locked by a cotter pin 48 or like means.

The invention is characterized by simplicity, economy of manufacture, and each and convenience of operation. It dispenses with the need for hammering on the inner end of a locking pin in a very cluttered and inaccessible location inside of the boom. Finally, when the locking pin 28 is retracted sufficiently to free the pivot shaft 17, this condition will be known to the operator because the threads of the extension 31 will just be separating from the threads of the nut 36, thus making the operation foolproof.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a crane boom pivot structure including a rotational crane boom pivot shaft, a crane turntable support bearing means for the ends of the pivot shaft and a crane boom section to rotate with the pivot shaft in unison therewith without relative rotational movement, the improvement comprising a cross axis locking pin for said pivot shaft and boom section including a screw-threaded portion, the pivot shaft having a cross axis bore receiving said locking pin, an adjacent locking member fixed rigidly to the boom section and being engaged by said locking pin to lock the pivot shaft and boom section against relative rotation on the axis of the pivot shaft, and a nut on the screw-threaded portion of the locking pin externally of the boom section, whereby the pivot pin can be placed through the cross axis bore of the pivot shaft and retracted therefrom while rotation of said nut is restrained and without necessitating access to the interior of said boom section.

2. In a crane boom pivot structure as defined in claim 1, and a rigid rotation restraining means for said nut on the exterior of said boom section loosely engaging said nut, said boom section having an adjacent clearance opening for the locking pin, whereby the latter can be laterally and angularly adjusted within limits.

3. In a crane boom pivot structure as defined in claim 2, and said screw-threaded portion of the locking pin having a length such that when the locking pin is retracted sufficiently to leave said cross axis bore and release the pivot shaft the threads of said screw-threaded portion are separating from the threads of said nut to thereby provide an indication of said retraction of the locking pin.

4. In a crane boom pivot structure as defined in claim 2, and a separable locking element on said nut blocking retraction of the locking pin from said cross axis bore due to vibration and being located on said nut so that it can be installed thereon only when the locking pin is fully inserted through said cross axis bore, whereby the installed separable locking element forms a safe indicator for said pivot structure.

5. In a crane boom pivot structure as defined in claim 2, and said rigid rotation restraining means comprising a pair of spaced opposing parallel track members, and said nut having a coacting pair of side flanges interfitting loosely with said track members.

6. In a crane boom pivot structure as defined in claim 4, and said separable locking element comprising a cross axis tethered locking pin engageable through a cross axis opening in said nut beyond the outer end of the locking pin and across such end, and the outer end of the locking pin having a non-circular socket recess to assist in retracting the locking pin.

7. In a crane boom pivot structure as defined in claim 1, and said adjacent locking member fixed rigidly to the boom section comprising a hub immediately surrounding the pivot shaft substantially at its longitudinal center and preventing pivot shaft deflection, and said hub having a cross axis bore adapted to register with the cross axis bore of the pivot shaft and receiving the locking pin therethrough.

8. In a crane boom pivot structure as defined in claim 7, and internal supporting means for said hub within said boom section including an internal transverse box member welded within said boom section, and a pair of spaced parallel vertical plates within said boom section welded at least to said box member and having opening means for the reception and support of said hub, said hub being welded to said pair of plates.

9. A crane boom pivot structure comprising a crane boom rotational pivot shaft requiring rigid locking to a crane boom section for unison rotation therewith around the axis of the pivot shaft, crane turntable bearing support means for the opposite end portion of said rotational pivot shaft, a locking member rigid with the crane boom section turning with said pivot shaft and being adjacent to the circumference of the pivot shaft, said locking member and said pivot shaft having alignable cross axis opening means therethrough, a rigid locking pin insertable through said opening means and having a threaded extension beyond the opening means and extending externally of said boom section, the boom section having a clearance opening receiving the threaded extension, and a loosely constrained threaded nut member on the threaded extension externally of said boom section enabling the pivot pin to be inserted and retracted from the exterior of the boom section and to be laterally and angularly adjusted within fixed limits.

10. A crane boom pivot structure as defined in claim 9, and the exterior end of said pivot shaft having a tool engaging turning means.

11. A crane boom pivot structure as defined in claim 9, and a removable blocking element for the locking pin engaged in said nut member outwardly of the locking pin to prevent retraction of the locking pin caused by vibrations.

* * * * *

UNITED STATES PATENT OFFICE

CERTIFICATE OF CORRECTION

Patent No. 4,337,867 Dated July 6, 1982

Inventor(s) Stanley R. Spain

It is certified that error appears in the above-identified patent and that said Letters Patent are hereby corrected as shown below:

In the Title, at [54], the spelling of "Curane" is corrected to "CRANE".

Signed and Sealed this

Seventh Day of September 1982

[SEAL]

Attest:

GERALD J. MOSSINGHOFF

Attesting Officer

Commissioner of Patents and Trademarks